US005524119A

United States Patent [19]

Marsh

[11] Patent Number: 5,524,119

[45] Date of Patent: Jun. 4, 1996

[54] TAPHOLE DESIGN AND POURING METHOD

[75] Inventor: Peter Marsh, Sheffield, United Kingdom

[73] Assignee: Forgemasters Steels Limited, Sheffield, England

[21] Appl. No.: 137,041

[22] PCT Filed: Apr. 3, 1992

[86] PCT No.: PCT/GB92/00602

§ 371 Date: Oct. 18, 1993

§ 102(e) Date: Oct. 18, 1993

[87] PCT Pub. No.: WO92/18818

PCT Pub. Date: Oct. 29, 1992

[30] Foreign Application Priority Data

Apr. 16, 1991 [GB] United Kingdom ..... 9108038

[51] Int. Cl.[6] ..... F27D 3/14

[52] U.S. Cl. ..... 373/83; 373/84; 266/45

[58] Field of Search ..... 373/79, 83, 84, 373/71, 72, 33, 143, 85; 266/45, 236, 47, 208; 222/593

[56] References Cited

U.S. PATENT DOCUMENTS

| | | | |
|---|---|---|---|
| 644,510 | 2/1900 | Frost | 373/85 |
| 1,338,881 | 5/1920 | Stock | 373/85 |
| 1,944,611 | 1/1934 | Reinartz et al. | 164/337 |
| 2,755,327 | 7/1956 | Tama | 373/143 |
| 2,937,789 | 5/1960 | Tama | 373/142 |
| 4,181,812 | 1/1980 | Collin | 373/85 |
| 4,273,315 | 6/1981 | Tinnes | 266/236 |
| 4,427,184 | 1/1984 | Steinwider et al. | 266/45 |
| 4,562,943 | 1/1986 | Freytag et al. | 373/142 |
| 4,697,274 | 9/1987 | Enkner et al. | 373/79 |
| 4,785,979 | 11/1988 | Svoboda et al. | 222/591 |
| 5,173,243 | 12/1992 | Laszlo | 266/45 |
| 5,240,231 | 8/1993 | Laszlo | 266/45 |

FOREIGN PATENT DOCUMENTS

| | | |
|---|---|---|
| 0352353 | 1/1990 | European Pat. Off. . |
| 2049136 | 12/1980 | United Kingdom . |
| 2097901 | 2/1985 | United Kingdom . |

OTHER PUBLICATIONS

Flo–Con Systems, Inc., "Flo–con Model 12800 Tap Hole Valve", 1983 (copyright date) pp. 1–5.

*Primary Examiner*—Tu Hoang
*Attorney, Agent, or Firm*—Oliff & Berridge

[57] ABSTRACT

An electric arc furnace or convertor is provided with a taphole collector nozzle which is provided, for at least a portion of its length, with an offset bore enlargement. The furnace may be a tilting arc furnace, and may be provided with a sliding gate taphole valve having a collector nozzle with an offset bore enlargement attached to the sliding gate.

26 Claims, 3 Drawing Sheets

TAPHOLE DESIGN AND POURING METHOD

TECHNICAL FIELD

This invention relates to an improved apparatus and method for pouring molten metal from a furnace or converter, and more particularly to an improved furnace or converter tap hole design.

BACKGROUND ART

Tilting electric arc furnaces, for example as used in steel manufacture, are provided with a taphole through which an oxygen lance can be inserted and from which the molten metal passes when the furnace is tilted at the end of the melting process. Traditionally the molten metal is poured into a trough, or launder, accompanied by a quantity of slag which becomes unavoidably entrained in the metal stream. To overcome the problem of slag contamination, it has recently been proposed to provide the taphole with a hydraulically operated sliding gate valve mechanism which provides a positive shut-off for the metal stream at the end of the pouring step and effectively prevents the slag, which floats on the surface of the metal, from entering the ladle. Such a device is, for example, supplied by Flogates Limited under the name FloCon Model 12800 Tap Hole Valve, and incorporates a collector nozzle.

The sliding gate taphole valve works well in practice, but, due to the extra length of taphole tube required to accommodate the valve mechanism and collector nozzle in certain types of furnaces, problems can arise due to turbulence in the metal stream, which adopts a jagged appearance and is difficult to pour accurately. Efforts to eliminate this problem have hitherto proved unsuccessful.

DISCLOSURE OF INVENTION

We have now discovered that an improved metal stream which is smoother and less turbulent can be produced by providing the taphole and/or collector nozzle with an offset bore enlargement. The reason for the improvement in flow is not entirely understood, but may result from an improved ability of dissolved gases to escape from the metal stream during its passage through the taphole tube and/or collector nozzle.

According to one aspect of the present invention there is provided a tilting electric arc furnace or converter having a taphole and/or collector nozzle which is provided, for at least a portion of its length, with an offset bore enlargement.

The invention also comprises a method of pouring molten metal from a tilting electric arc furnace or converter, in which the metal is discharged through a taphole and/or collector nozzle which is provided, for at least a portion of its length, with an offset bore enlargement.

In another aspect, the invention also provides a sliding gate taphole valve provided with a collector nozzle, the collector nozzle being provided, for at least a portion of its length, with an offset bore enlargement, a collector nozzle having an offset bore enlargement for use therewith, and a gate set incorporating such a collector nozzle.

Although it is envisaged that the principle of the offset bore enlargement could be applied to the taphole itself, to the collector nozzle, or to both the taphole and the collector nozzle, it is usually simpler and more convenient to form the offset bore enlargement solely in the bore of the collector nozzle. The invention will thus be further exemplified with respect to such a collector nozzle having an offset bore enlargement but is not to be taken as limited thereto.

The collector nozzle can be fixed immovably to the furnace or converter but is preferably attached to the sliding gate of a sliding gate valve mechanism of the type previously mentioned.

The enlargement to the collector nozzle bore is offset from the central line of the bore and is usually, though not necessarily exclusively, an enlargement to the vertical height of the bore. Other directions of the enlargement may also be possible, and the invention also includes the possibility of more than one such enlargement offset in different and possibly opposite directions from the central line. However, preferably the height of the bore is greater than the width, and for example the bore may be of ovoid, elliptical or any other suitable non-circular cross-sectional shape. Preferably the enlargement to the collector nozzle is achieved by simply increasing the height of the bore by, for example, from 10 to 20% of the diameter. The offset bore enlargement may extend for only a short distance, but preferably it extends for substantially the full length of the collector nozzle. Preferably the offset bore enlargement extends from the exit end of the collector nozzle towards the furnace, and most preferably it extends for the full length of the collector nozzle, apart from a small lead-in portion at the furnace end.

As an example, if the bore is say 6 inches in diameter, a suitable height increase would be 1 inch, giving a roughly ovoid cross-section. The length of the bore which is enlarged in this fashion is usually at least 15 inches, measured from the exit of the collector nozzle, and preferably from 15 to 25 inches.

It has also been discovered than an improvement in stream quality can be obtained by providing the sloping floor of the furnace or converter with a gentle tap slope of 20° or less leading up to the entrance to the taphole. The combination of this feature with the offset bore enlargement of the collector nozzle has been found to give excellent results in practice.

The bore of the taphole can be straight, but preferably it is slightly tapered towards the end leading to the collector nozzle. This also has been found to give improved results in certain circumstances.

BRIEF DESCRIPTION OF DRAWINGS

An embodiment of the invention will now be described with reference to the accompanying Drawings in which.

DETAILED DESCRIPTION OF DRAWINGS

Figure 1:
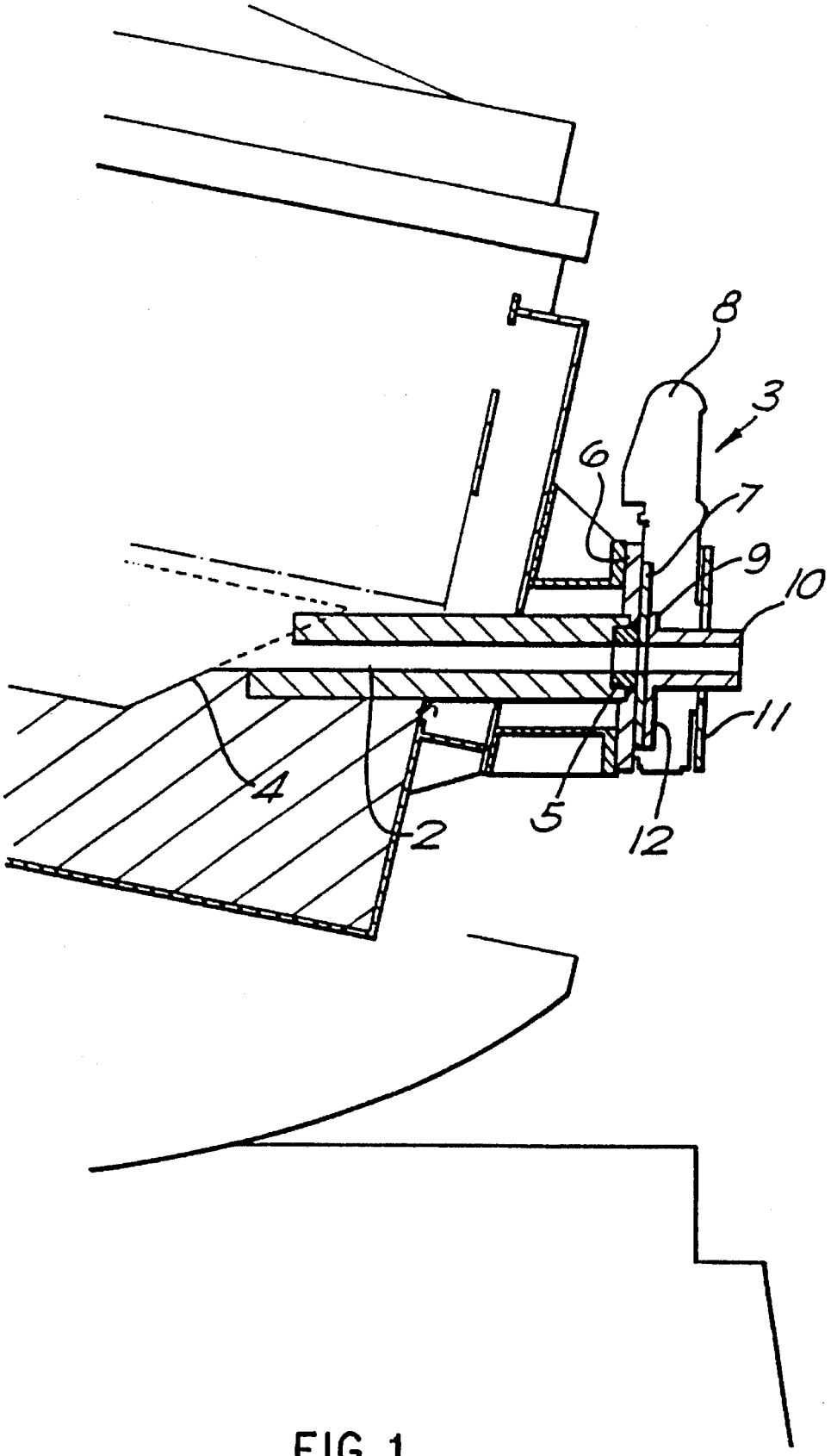
FIG. 1 PRIOR ART
FIG. 1 shows, in sectional side elevation, a prior art arrangement of a tilting electric arc furnace having a taphole fitted with a sliding gate valve mechanism.

Referring now to FIG. 1, a tilting electric arc furnace is provided with a taphole 2 of uniform bore, and a sliding gate valve mechanism 3. The floor of the furnace has a steep tap slope 4 leading to the taphole tube entrance. The furnace is shown tilted in the ready-to pour position, with the sliding gate valve open. At the exit to the taphole is a well or inlet nozzle 5 surrounded by a mounting plate 6. Attached to the mounting plate is a stationary top fixed plate 7.

The hydraulic drive operating mechanism 8 comprises a hydraulic drive cylinder and piston rod (not shown) which moves the sliding gate 9 in a vertical direction between its open and closed positions. Attached to the sliding gate 9 is a collector nozzle 10, having a uniform bore, and a heat shield 11. In the closed position the sliding gate is raised so that the plate 12 blocks the exit to the well nozzle 5. The gate is raised when the furnace has been emptied of the required amount of liquid metal, or when furnace slag is sighted in the tap ladle.

Figure 2:
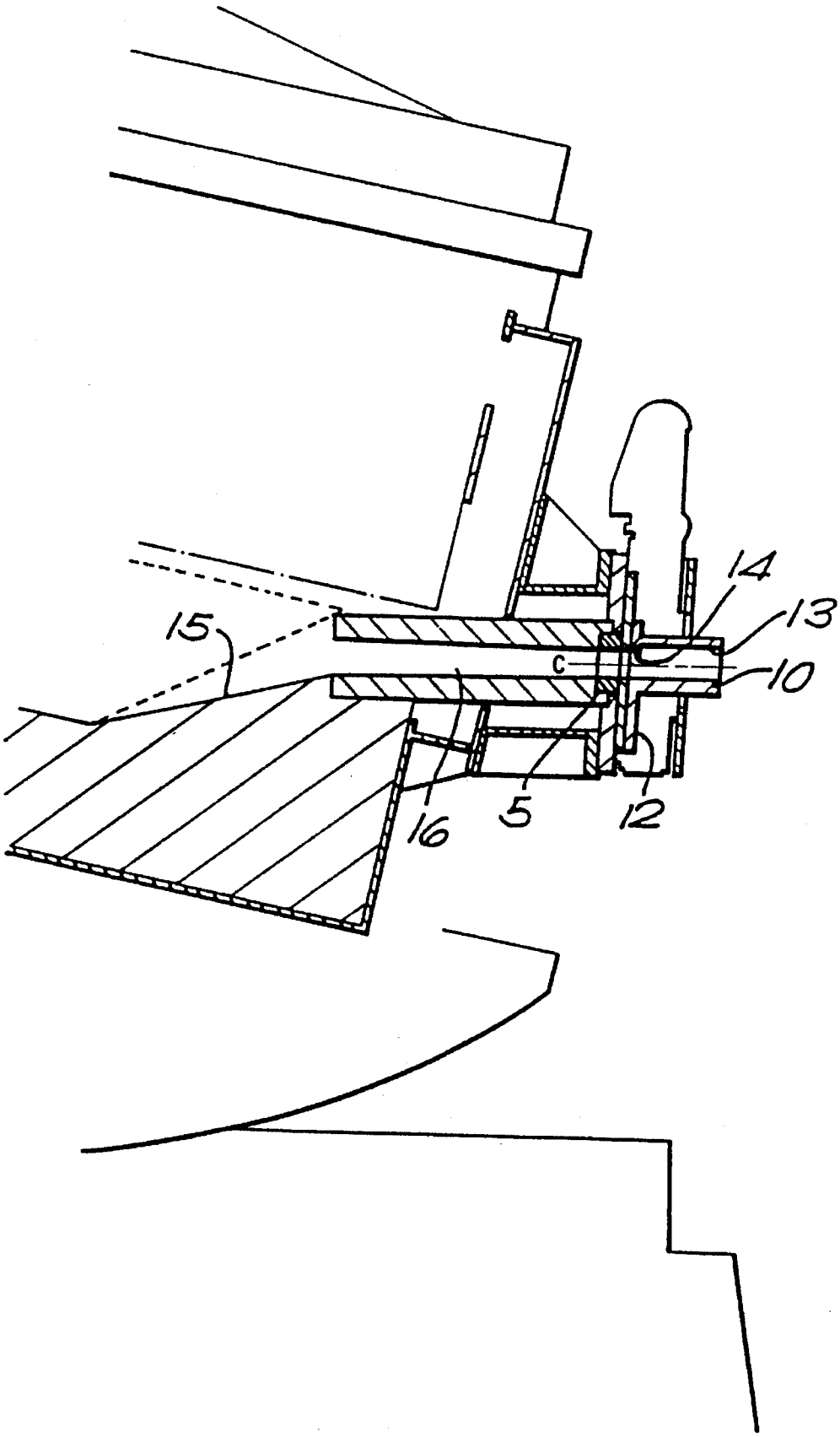
FIG. 2 shows, also in sectional side elevation, a tilting electric arc furnace according to the invention having a sliding gate valve mechanism and a collector nozzle with an offset bore enlargement.
Figure 3:
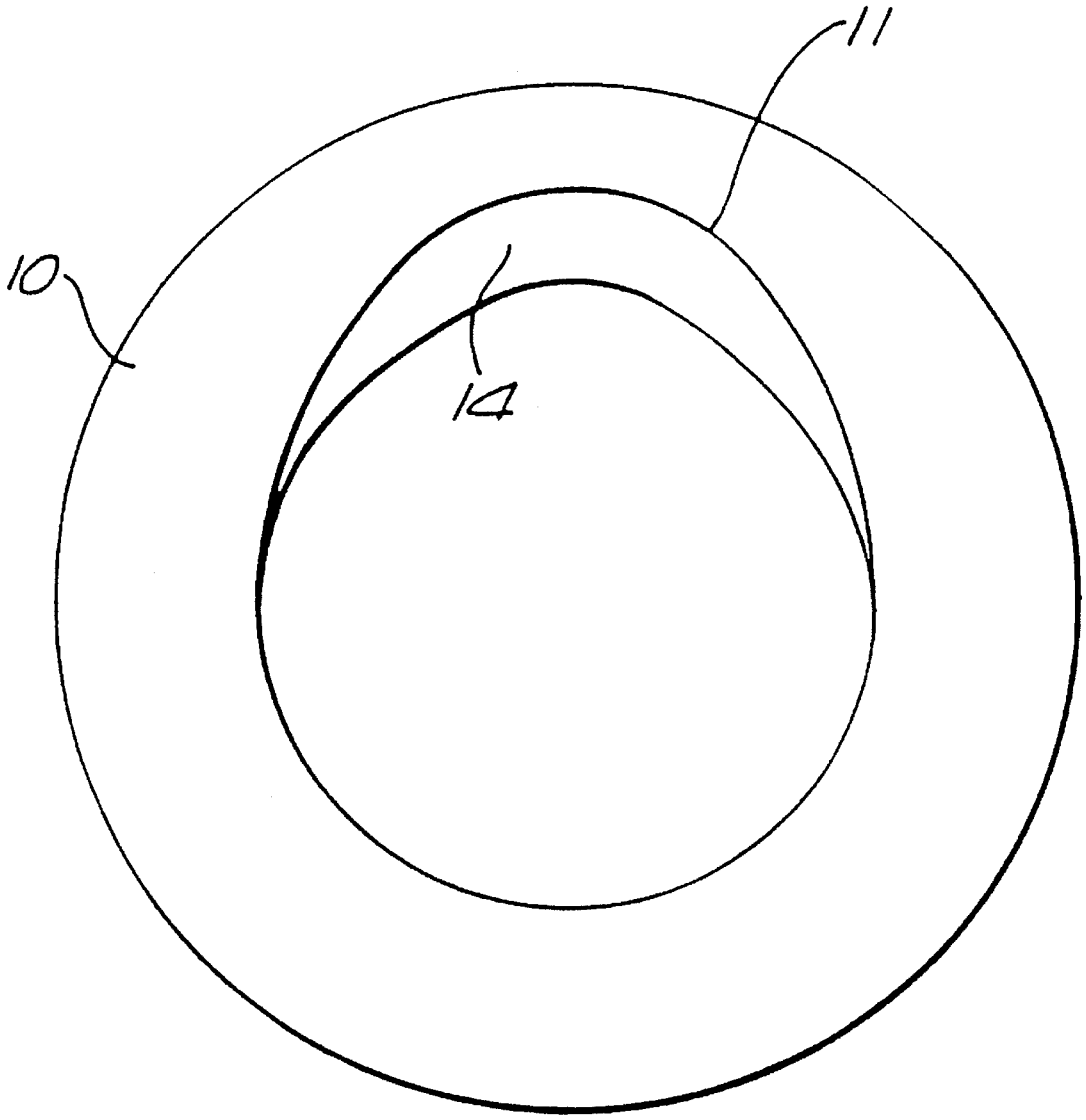
FIG. 3 shows an end elevation of the collector nozzle of FIG. 2, looking into the furnace.

An embodiment of the invention is shown in FIG. 2, where the reference numerals have the same significance as in FIG. 1. It will be observed that the bore of the collector nozzle 10, with respect to its central axis, has a vertically offset enlargement 13 which extends for the full length of the collector nozzle bore, apart from a small lead-in portion 14. In addition, the floor of the furnace has a longer, more gentle and uniform tap slope 15 having an angle of slope of 20° leading to the entrance to the taphole. The taphole bore 16 has a slight taper, its diameter decreasing slightly from entrance to exit. The shape of the offset bore of the collector nozzle can readily be seen from FIG. 3.

In operation, at the end of the refining stage, the furnace is tilted and the sliding gate carrying the collector nozzle 10 is lowered to the open position. Molten metal then passes through the tap hole 2 and the collector nozzle 10 and is received, for example, in a ladle. It is found that the furnace according to the invention provides a much more uniform metal stream with far less splashing and turbulence than the prior art arrangement.

Prior art tilting electric arc furnaces having sliding gate taphole valves are readily converted to the new design of the invention by the provision of a new gate set:, comprising various refractory components including a refractory collector nozzle according to the invention, a fixed plate, a sliding plate and an inlet nozzle. Gate sets are regularly supplied by the manufacturers of sliding gate taphole valves for the replacement of worn components. The invention is applicable to a wide range of metal refining processes, but is particularly useful in the production of high carbon alloy and stainless steels requiring tight analytical tolerances and high cleanliness.

The reader's attention is directed to all papers and documents which are filed concurrently with this specification and which are open to public inspection with this specification, and the contents of all such papers and documents are incorporated herein by reference.

I claim:

1. A tilting electric arc furnace comprising a taphole and a collector nozzle in communication with said taphole, said collector nozzle having a uniform bore for passage of molten metal therethrough, said bore having an offset enlargement which is offset with respect to a central axis of said bore.

2. A furnace according to claim 1, wherein said taphole includes a taphole bore for enabling molten metal to flow into said bore of said collector nozzle.

3. A furnace according to claim 2, wherein the collector nozzle is attached to a sliding gate of a sliding gate valve mechanism.

4. A furnace according to claim 2, wherein the enlargement is an enlargement to a vertical height of the bore of the collector nozzle.

5. A furnace according to claim 4, wherein the height of the bore is increased by 10 to 20% of a diameter of the bore.

6. A furnace according to claim 2, wherein the enlargement extends from an exit end of the collector nozzle.

7. A furnace according to claim 6, wherein a length of the bore is from 15 to 25 inches.

8. A furnace according to claim 2, wherein the enlargement extends substantially the length of the collector nozzle.

9. A furnace according to claim 2, wherein the furnace has a floor having a slope of between about zero and about 20 degrees leading up to an entrance to the taphole.

10. A furnace according to claim 2, wherein the bore of said taphole is tapered towards an end thereof leading to the collector nozzle.

11. A method of pouring molten metal from a tilting electric arc furnace comprising the step of discharging the molten metal from a taphole through a collector nozzle, wherein the collector nozzle has a bore provided, for at least a portion of the length thereof, with an enlargement offset with respect to a central axis of said bore.

12. A method according to claim 11, wherein the step of discharging occurs through a taphole having a bore for enabling the metal to flow into said bore of said collector nozzle.

13. A method according to claim 11, wherein the step of discharging occurs through a sliding gate valve and said collector nozzle is attached to the sliding gate valve.

14. A method according to claim 12, wherein the furnace has a floor having a slope of between about zero and about 20 degrees leading up to an entrance of the taphole.

15. A method according to claim 12, wherein the bore of the taphole is tapered towards an end thereof leading to the collector nozzle.

16. A sliding gate taphole valve provided with a collector nozzle, wherein the collector nozzle has a uniform bore including an enlargement offset with respect to a central axis of said bore.

17. A collector nozzle for a tilting electric arc furnace, said collector nozzle having a uniform bore including an enlargement offset with respect to a central axis of said bore.

18. A collector nozzle according to claim 17, wherein said collector nozzle is adapted to be attached to a sliding gate valve mechanism.

19. A collector nozzle according to claim 17, wherein the enlargement is an enlargement to a vertical height of the bore of the collector nozzle.

20. A collector nozzle according to claim 17, wherein a height of the bore is increased by from 10 to 20% of a diameter of the bore.

21. A collector nozzle according to claim 17, wherein the enlargement extends from an exit end of the collector nozzle.

22. A collector nozzle according to claim 17, wherein a length of the bore is from 15 to 25 inches.

23. A collector nozzle according to claim 17, wherein the enlargement extends substantially for a full length of the collector nozzle.

24. A connector nozzle according to claim 17 in combination with a gate set for a sliding gate taphole valve.

25. A taphole for a tilting electric arc furnace, which is provided with gas escape means for allowing dissolved gases to escape from a metal stream during passage thereof through the taphole when the metal stream is poured, said means including a uniform bore including an enlargement offset with respect to a central axis of said bore.

26. A collector nozzle for a tilting electric arc furnace, which is provided with means which, on pouring, allows dissolved gases to escape from a metal stream during passage thereof through the collector nozzle, said means including a uniform bore including an enlargement offset with respect to a central axis of said bore.

* * * * *

UNITED STATES PATENT AND TRADEMARK OFFICE

CERTIFICATE OF CORRECTION

PATENT NO. : 5,524,119

DATED : June 4, 1996

INVENTOR(S) : Peter MARSH

It is certified that error appears in the above-indentified patent and that said Letters Patent is hereby corrected as shown below:

Title page, item

[73], Assignee: should read--Flogates Limited, Sheffield, England--.

Signed and Sealed this

Twenty-first Day of October 1997

*Attest:*

Bruce Lehman

BRUCE LEHMAN

*Attesting Officer*

*Commissioner of Patents and Trademarks*